US011070900B2

(12) United States Patent
Yoshino

(10) Patent No.: US 11,070,900 B2
(45) Date of Patent: Jul. 20, 2021

(54) MICROPHONE

(71) Applicant: Audio-Technica Corporation, Tokyo (JP)

(72) Inventor: Satoshi Yoshino, Tokyo (JP)

(73) Assignee: Audio-Technica Corporation, Tokyo (JP)

( * ) Notice: Subject to any disclaimer, the term of this patent is extended or adjusted under 35 U.S.C. 154(b) by 0 days.

(21) Appl. No.: 16/748,105

(22) Filed: Jan. 21, 2020

(65) Prior Publication Data

US 2020/0236453 A1 Jul. 23, 2020

(30) Foreign Application Priority Data

Jan. 23, 2019 (JP) ..... JP2019-009703

(51) Int. Cl.

| | |
|---|---|
| ***H04R 1/04*** | (2006.01) |
| ***F21V 33/00*** | (2006.01) |
| ***H04R 1/08*** | (2006.01) |
| ***H04R 1/32*** | (2006.01) |

(52) U.S. Cl.

CPC ..... *H04R 1/083* (2013.01); *F21V 33/0056* (2013.01); *H04R 1/04* (2013.01); *H04R 1/326* (2013.01)

(58) Field of Classification Search

CPC ..... H04R 1/083; H04R 1/04; H04R 1/326; F21V 33/0056

See application file for complete search history.

(56) References Cited

U.S. PATENT DOCUMENTS

| | | | |
|---|---|---|---|
| 3,054,944 | A | 9/1962 | Brooke et al. |
| 3,104,398 | A | 9/1963 | Palmaer |
| 3,201,881 | A | 8/1965 | Dechar |
| 3,445,597 | A | 5/1969 | Walters |
| 3,729,923 | A | 5/1973 | Brigliano |
| D254,616 | S | 4/1980 | Tabata |
| 4,322,879 | A | 4/1982 | Kelley |
| 4,383,879 | A | 5/1983 | Le Du et al. |
| D270,634 | S | 9/1983 | Ungar |
| D291,690 | S | 9/1987 | Tabachnik |
| D299,454 | S | 1/1989 | Kwong |
| D301,145 | S | 5/1989 | Besasie et al. |

(Continued)

FOREIGN PATENT DOCUMENTS

| | | |
|---|---|---|
| CN | 201 629 826 U | 11/2010 |
| EM | 002079673-0007 | 7/2012 |

(Continued)

*Primary Examiner* — Regina N Holder
(74) *Attorney, Agent, or Firm* — W & C IP

(57) ABSTRACT

A microphone including a light emitting part can be miniaturized.

The microphone includes: a microphone unit; an impedance converter that converts output impedance of the microphone unit; a light source that notifies an operation state of the microphone unit; a conversion substrate on which the impedance converter is mounted; a light source substrate on which the light source is mounted; and a connection substrate to which a signal line for transmitting a signal from the impedance converter and a power line for transmitting power to the light source are connected. The conversion substrate, the light source substrate, and the connection substrate are three-dimensionally connected to one another to constitute one substrate unit.

18 Claims, 10 Drawing Sheets

(56) References Cited

U.S. PATENT DOCUMENTS

| | | | | |
|---|---|---|---|---|
| 4,875,143 | A | 10/1989 | Fernandez | |
| D313,092 | S | 12/1990 | Nilsson | |
| 5,003,589 | A | 3/1991 | Chen | |
| D319,241 | S | 8/1991 | Daido et al. | |
| 5,574,795 | A | 11/1996 | Seki | |
| 5,893,626 | A | 4/1999 | Poling | |
| 6,611,963 | B2 | 9/2003 | Woo et al. | |
| 6,724,906 | B2 | 4/2004 | Naksen | |
| 7,010,139 | B1 | 3/2006 | Smeehuyzen | |
| D518,474 | S | 4/2006 | Suzuki | |
| D519,497 | S | 4/2006 | Komiyama | |
| 7,090,378 | B1 | 8/2006 | Zadro | |
| D560,654 | S | 1/2008 | Feng | |
| D668,633 | S | 10/2012 | Enquist | |
| 8,342,710 | B2 | 1/2013 | Rahbar-Dehghan | |
| D688,648 | S | 8/2013 | Li et al. | |
| D700,590 | S | 3/2014 | Heath | |
| 8,926,117 | B2 | 1/2015 | Blanchette | |
| D733,090 | S | 6/2015 | Petersen | |
| 9,247,333 | B2 | 1/2016 | Akino | |
| D758,991 | S | 6/2016 | Petersen | |
| D790,504 | S | 6/2017 | Tam | |
| D795,218 | S | 8/2017 | Ohmachi | |
| D796,478 | S | 9/2017 | Minn et al. | |
| 9,866,946 | B2 | 1/2018 | Chen et al. | |
| D830,330 | S | 10/2018 | Petersen | |
| D830,331 | S | 10/2018 | Petersen et al. | |
| D830,993 | S | 10/2018 | Petersen et al. | |
| D837,763 | S | 1/2019 | Suzuki | |
| D860,161 | S | 9/2019 | Xia | |
| D861,637 | S | 10/2019 | Williamson et al. | |
| D864,896 | S | 10/2019 | Zhang | |
| D866,514 | S | 11/2019 | Lindof | |
| D868,030 | S | 11/2019 | Chong | |
| D868,728 | S | 12/2019 | Zaihui | |
| D868,733 | S | 12/2019 | Luo | |
| D869,430 | S | 12/2019 | Rama et al. | |
| D870,064 | S | 12/2019 | Petersen | |
| D870,069 | S | 12/2019 | Hu | |
| 2008/0056525 | A1 | 3/2008 | Fujiwara et al. | |
| 2011/0206221 | A1* | 8/2011 | Yoshino | H04R 1/086 381/174 |
| 2016/0198250 | A1 | 7/2016 | Pan | |
| 2017/0134840 | A1* | 5/2017 | Furuya | H04R 1/083 |

FOREIGN PATENT DOCUMENTS

| | | | |
|---|---|---|---|
| EM | 005762507-0001 | | 2/2018 |
| EM | 005762507-0001 | | 11/2018 |
| JP | 2015-082676 | A | 4/2015 |
| JP | 2017-092587 | A | 5/2017 |
| JP | 2018-110333 | A | 7/2018 |
| JP | 6 388 833 | B2 | 9/2018 |

* cited by examiner

MICROPHONE

TECHNICAL FIELD

The present invention relates to a microphone.

BACKGROUND ART

For example, a gooseneck microphone is used as a microphone for conferences, speeches and press conferences and the like. The gooseneck microphone is installed on a speaker's desk and is directed to the speaker's mouth. Therefore, when a third party such as a conference participant looks at the speaker's face, the gooseneck microphone may hide a part of the speaker's face (expression), because it is located in front of the speaker's face. In particular, in a press conference in which a plurality of microphones are directed to a speaker, these microphones are photographed with the speaker and hide the speaker's face (expression). Consequently, inconspicuous thin (small) microphones are desired.

In order to allow, for example, a speaker, a conference participant, and an acoustic engineer to grasp an operation state (microphone ON, OFF and the like) of a microphone at a glance, a gooseneck microphone provided with a light source has been proposed (for example, see Japanese Unexamined Patent Application Publication No. 2017-92587).

The microphone disclosed in Japanese Unexamined Patent Application Publication No. 2017-92587 includes a bottomed cylindrical microphone case (hereinafter, referred to as a "case"), a condenser microphone unit (hereinafter, referred to as a "unit"), a circuit board on which a circuit such as a field effect transistor (FET) is mounted, a light source mounting substrate on which a light source (light emitting diode (LED)) is mounted, a holding member that holds the circuit board and the light source mounting substrate, a light guiding member that guides light from the light source, an arm member that adjusts a sound collection direction of the unit, and a body that connects the case and one end of the arm member.

The unit is accommodated at a non-opening end of the case. The holding member is accommodated near an opening end of the case in a state of holding the circuit board and the light source mounting substrate. The light source mounting substrate is accommodated in the case such that the light source faces the opening side of the case. The circuit board is accommodated in the case and disposed between the unit and the holding member. Each of the circuit board and the light source mounting substrate is grounded via the holding member and the case.

The light guiding member has a substantially cylindrical shape and includes an incident surface on which the light from the light source is incident, a reflective surface that reflects light from the light source, and an emitting surface that emits light from the reflective surface. The light guiding member is disposed at the opening end of the case. The body is attached to the holding member to interpose the emitting surface of the light guiding member with the opening end of the case. The light from the light source is guided to the light guiding member and is emitted outward in the radial direction of the case from the emitting surface disposed between the case and the body. As a result, a conference participant and a speaker themselves can grasp the operation state of the microphone at a glance.

As described above, the circuit board and the light source mounting substrate are accommodated in the case having conductivity, and the holding member having conductivity, so that the circuit board and the light source mounting substrate are electrically shielded from, for example, external electromagnetic waves. The light from the light source mounted on the light source mounting substrate is guided to the outside of the case and the holding member by the light guiding member. That is, the microphone disclosed in Japanese Unexamined Patent Application Publication No. 2017-92587 can electrically shield a substrate such as the circuit board and radiate the light from the light source to the outside of the microphone. However, since the microphone disclosed in Japanese Unexamined Patent Application Publication No. 2017-92587 electrically shields the substrate such as the circuit board by using the holding member, a miniaturization of the case that accommodates the holding member is limited.

Power to each of the FET and the light source is supplied from a common external power source (phantom power source) via a connector with, for example, a phantom power feeding method defined in JEITA RC-8242C "microphone power supply method". The power from the connector to the FET is supplied via a signal line through which a sound signal from the unit is transmitted. The power from the connector to the light source is supplied via a power line for the light source (for example, see Japanese Unexamined Patent Application Publication No. 2018-110333).

Each of the signal line and the power line is connected to the circuit board by a solder, for example. That is, the circuit board includes: a mounting region where a circuit such as FET is mounted; and a connection region to which each of the signal line and the power line is connected. For example, when the light source is provided with multicolor LEDs, since forward drop voltages of RGB LEDs are different, power lines corresponding to each RGB are wired. These power lines are connected to the connection region. As a result, the connection region becomes large. On the other hand, for example, when a buffer circuit is mounted in the mounting region in order to reduce the number of signal lines (for example, see Japanese Unexamined Patent Application Publication No. 2015-82676), the connection region becomes small, but the mounting region becomes large. As described above, since securing the mounting region and the connection region on the circuit board is necessary, a miniaturization of the circuit board is difficult.

Furthermore, when a plurality of circuit boards are disposed in a relatively thin case of the microphone, each circuit board is disposed along a length direction of the case. Therefore, the case (microphone) tends to be long. That is, a structure for electrically shielding each circuit board tends to be long and complicated. As a result, shielding failure for each circuit board may occur.

By contrast, for example, when a plurality of circuit boards are disposed in the case in a layered shape, this arrangement can shorten the length of the case (microphone). In this case, the circuit boards are connected to one another with, for example, a lead wire. Each of the signal line and the power line is connected to the circuit board from a direction perpendicular to the circuit board. Therefore, a mechanical load is likely to be applied to a solder used for each connection (particularly connection between each of the signal line and the power line and the circuit board). Furthermore, insertion and fixing of each circuit board into the case are difficult. Consequently, connection failure such as a solder crack is likely to occur due to an impact of, for example, dropping of the microphone.

As described above, in the microphone including the light source (light emitting part), miniaturization of the case and the circuit board, that is, miniaturization of the microphone is problematic.

SUMMARY OF INVENTION

Technical Problem

An object of the present invention is to miniaturize a microphone including a light source (light emitting part).

Solution to Problem

The microphone according to the present invention includes: a microphone unit; an impedance converter that converts output impedance of the microphone unit; a light source that notifies an operation state of the microphone unit; a conversion substrate on which the impedance converter is mounted; a light source substrate on which the light source is mounted, and a connection substrate to which a signal line that transmits a signal from the impedance converter and a power line that transmits power to the light source are connected. The conversion substrate, the light source substrate, and the connection substrate are three-dimensionally connected to one another to constitute one substrate unit.

Advantageous Effects of Invention

According to the present invention, a microphone including a light source (light emitting part) can be miniaturized.

DESCRIPTION OF EMBODIMENTS

Microphone

Embodiments of a microphone according to the present invention will now be described with reference to the attached drawings.

Configuration of Microphone

Figure 1:
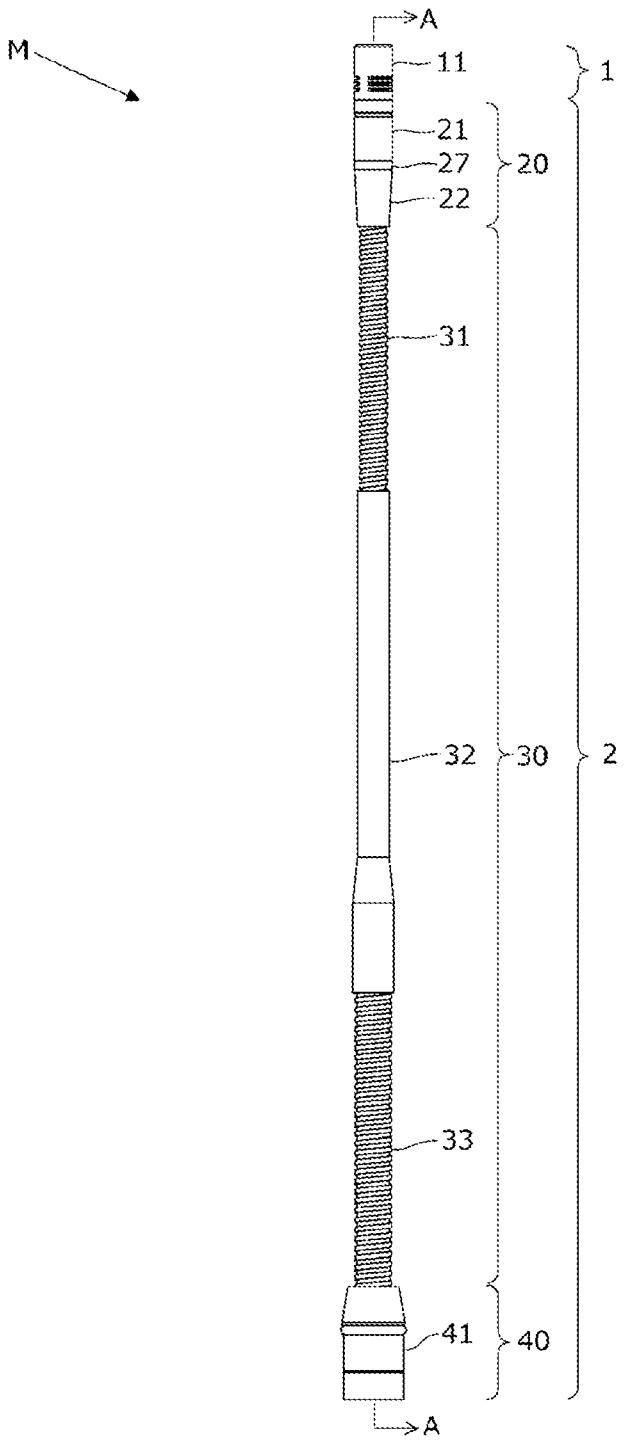
FIG. 1 is a side view illustrating an embodiment of a microphone according to the present invention.

FIG. 1 is a side view illustrating an embodiment of a microphone according to the present invention.

The microphone M collects sound waves from a sound source (not illustrated) and outputs electrical signals (sound signals) corresponding to the sound waves. The microphone M is, for example, a gooseneck microphone that is attached to and detached from a stand disposed on a table and the like in a conference room. The microphone M includes a microphone capsule (hereinafter, referred to as a "capsule") 1 and a modular gooseneck section (hereinafter, referred to as a "modular") 2.

In the description below, a direction (direction to the upper side of FIG. 1) in which the capsule 1 is directed when collecting the sound waves from the sound source is referred to as upward and an opposite direction thereof (direction to the lower side of FIG. 1) is referred to as downward.

Figure 2:
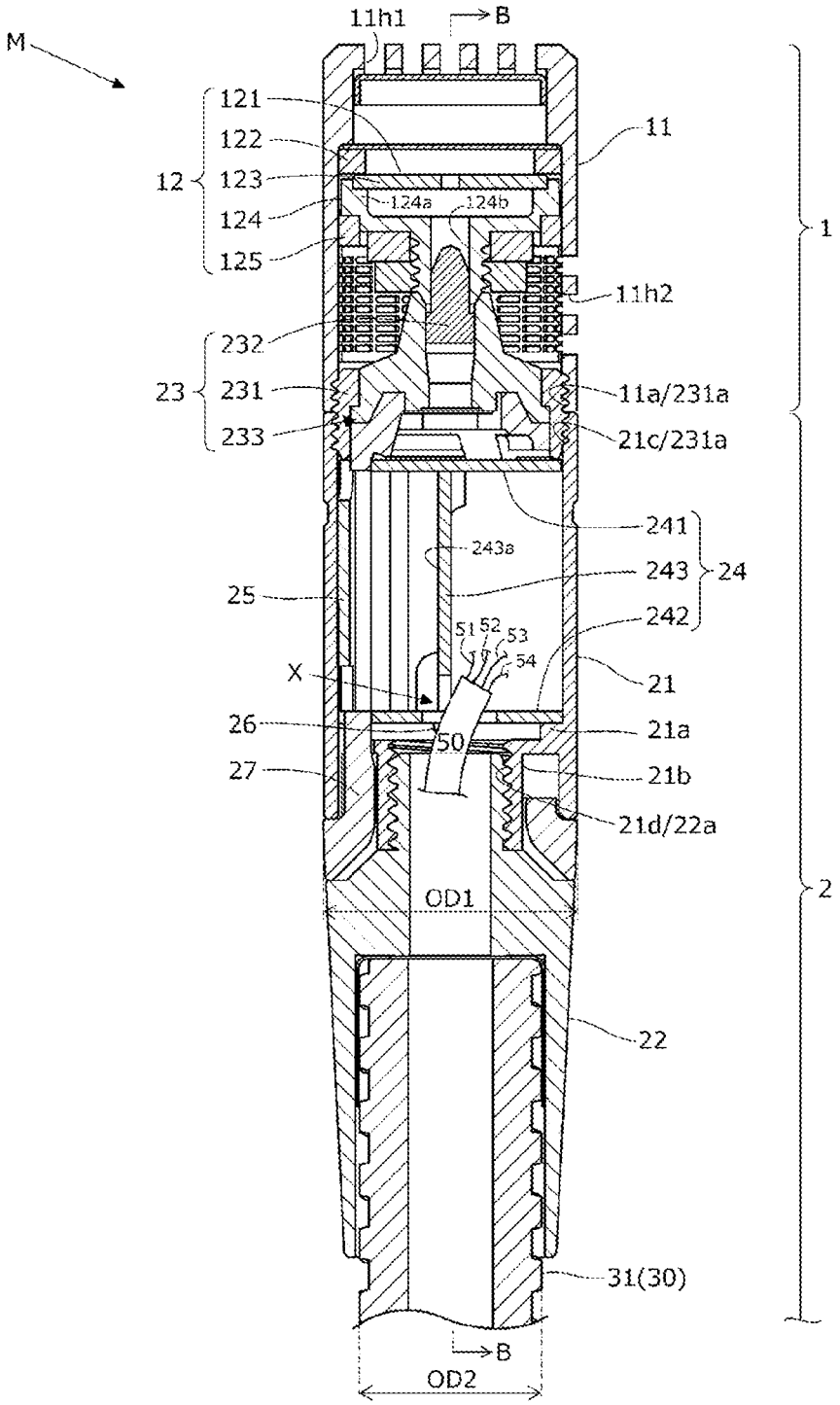
FIG. 2 is a partially enlarged cross-sectional view taken along line A-A of the microphone of FIG. 1.

FIG. 2 is a partially enlarged cross-sectional view taken along line A-A of the microphone M of FIG. 1.

Figure 3:
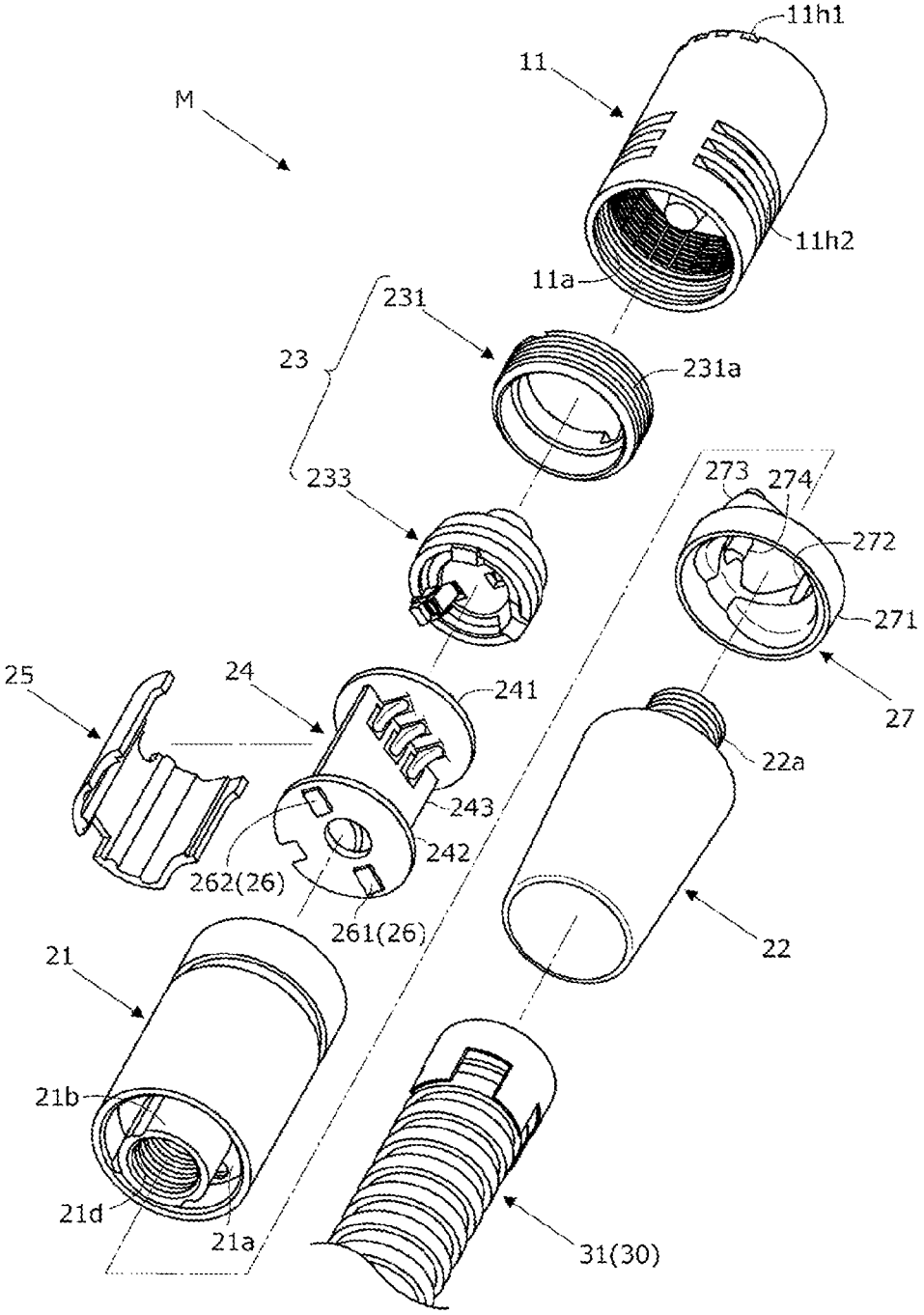
FIG. 3 is a partially exploded perspective view of the microphone of FIG. 1.
Figure 4:
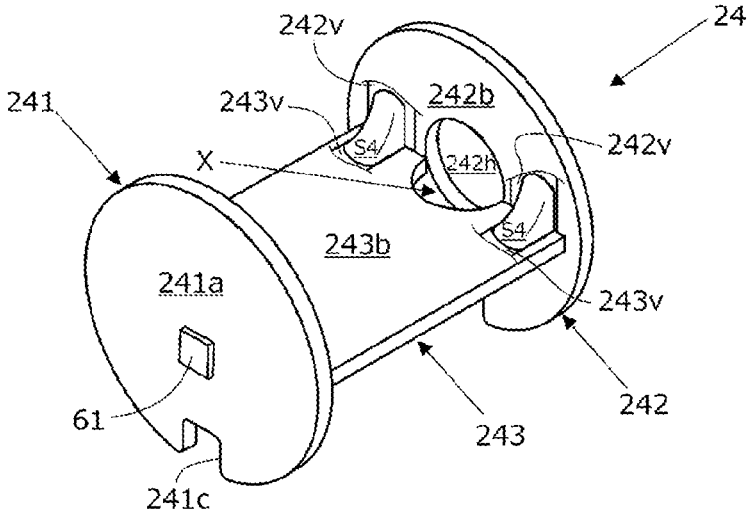
FIG. 4 is a perspective view of a substrate unit included in the microphone of FIG. 1.

FIG. 3 is a partially exploded perspective view of the microphone M.

The capsule 1 is directed to the sound source and collects the sound waves from the sound source. The capsule 1 is attachable to and detachable from the modular 2 (the capsule 1 is replaceable). The capsule 1 includes a capsule case 11 and a microphone unit 12.

The capsule case 11 accommodates the microphone unit 12. The capsule case 11 is a unit case in the present invention. The capsule case 11 is made of metal and has a bottomed cylindrical shape with an open lower end. The capsule case 11 includes a plurality of sound holes **11*h*1 and 11*h*2 and a female screw part 11*a*. The sound holes 11*h*1 are disposed on an upper surface of the capsule case 11. The sound holes 11*h*2 are disposed on a circumferential surface of the capsule case 11. The female screw part 11*a* is disposed on an inner circumferential surface at the lower end of the capsule case 11**.

The microphone unit 12 collects the sound waves from the sound source and generates the electrical signals (sound signals) corresponding to the sound waves. The microphone unit 12 is a unidirectional condenser microphone unit. The microphone unit 12 is accommodated in the capsule case 11. The microphone unit 12 includes a diaphragm 121, a diaphragm holder 122, a fixed electrode 123, a fixed electrode holder 124, and an insulator 125.

It should be noted that the directionality of the microphone unit is not limited to the unidirectionality. That is, for example, the microphone unit may be an omnidirectional condenser microphone unit.

The diaphragm 121 is vibrated by sound waves guided into the capsule case 11 via the sound holes **11*h*1 and 11*h*2. The diaphragm 121 is a circular thin film. A metal (for example, gold) film is deposited on one surface of the diaphragm 121. The diaphragm holder 122 is made of metal and has a ring shape. The diaphragm 121 is attached to a lower surface of the diaphragm holder 122** in a state in which predetermined tension is applied.

The fixed electrode 123 is a metal disk. The fixed electrode 123 is disposed to face the diaphragm 121 and constitutes a condenser with the diaphragm 121. The fixed electrode holder 124 is made of metal and is provided with a dish-shaped support part 124*a* and a cylindrical contact part 124*b*. The contact part 124*b* extends downward from a lower surface of the support part 124*a*. The fixed electrode 123 is supported on an upper end of the support part 124*a*. The insulator 125 insulates between the capsule case 11 and the fixed electrode holder 124. The insulator 125 is made of synthetic resin and has a ring shape.

Referring back to FIG. 1, the modular 2 has a plurality of functions for the capsule 1. The functions of the modular 2, for example, include processing a sound signal from the capsule 1, adjusting the direction of the capsule 1, and notifying the operation state of the capsule 1. The modular 2 includes an input part 20, a connection part 30, an output part 40, a lead wire 50 (see FIG. 2), and a mounting element 60 (see FIG. 8).

Referring back to FIGS. 2 and 3, the input part 20 (see FIG. 1) amplifies the sound signals from the capsule 1 and outputs the amplified sound signal to the connection part 30. The input part 20 includes a first case 21, a second case 22, a connection member 23, a substrate unit 24, a spacer 25, a light source 26, and a light guide member 27.

The first case 21 accommodates the substrate unit 24, the spacer 25, the light source 26, and a part of the light guide member 27. The first case 21 is made of metal and has a substantially cylindrical shape. The first case 21 includes a substrate holding part 21*a*, an insertion part 21*b*, a first female screw part 21*c*, and a second female screw part 21*d*.

An inner circumferential surface near a lower end of the first case 21 protrudes in an elliptical ring shape inside the first case 21 and constitutes the substrate holding part 21*a* that holds the substrate unit 24. A lower surface of the substrate holding part 21*a* extends downward in a cylindrical shape and constitutes the insertion part 21*b* through which the lead wire 50 is passed. The first female screw part 21*c* is disposed on an inner circumferential surface at an upper end of the first case 21. The second female screw part 21*d* is disposed on an inner circumferential surface of the insertion part 21*b*.

The second case 22 accommodates an upper end of the connection part 30 and connects the connection part 30 and the first case 21. The second case 22 is made of metal and has a substantially hollow circular truncated cone shape that tapers downward. The second case 22 includes a male screw part 22*a*. An upper end of the second case 22 extends upward in a cylindrical shape. The male screw part 22*a* is disposed on an outer circumferential surface at the extended upper end of the second case 22.

Figure 5:
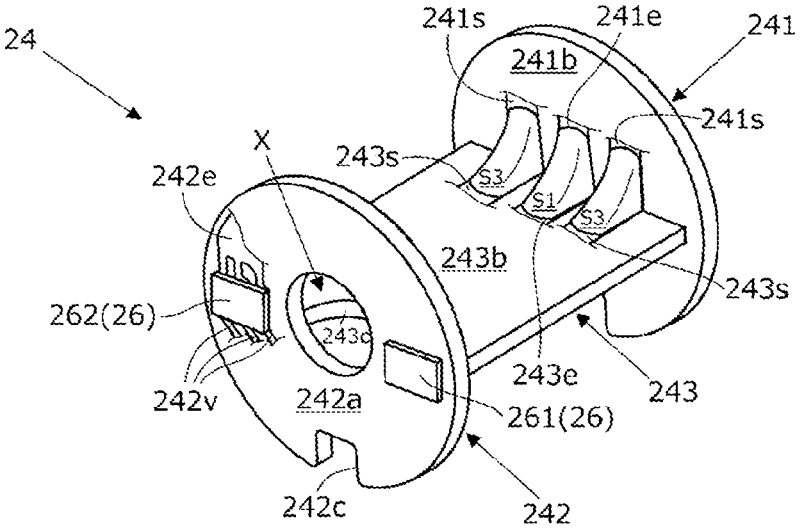
FIG. 5 is a perspective view of the substrate unit of FIG. 4 viewed from another direction.
Figure 6:
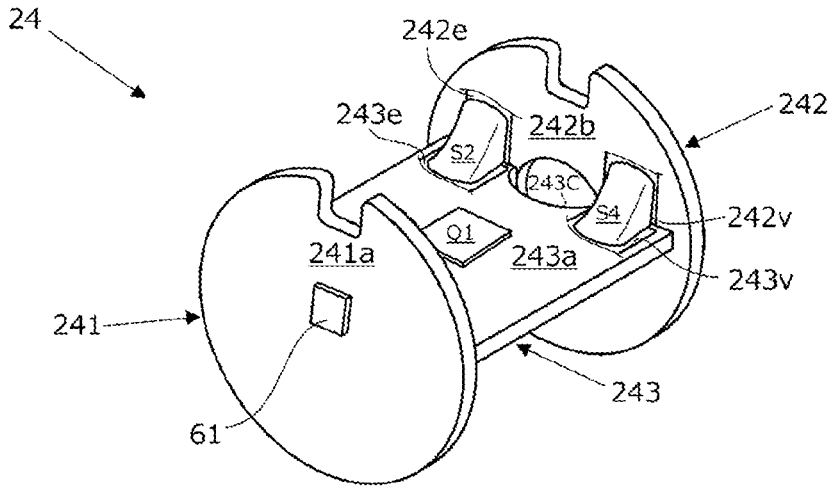
FIG. 6 is a perspective view of the substrate unit of FIG. 4 viewed from yet another direction.
Figure 7:
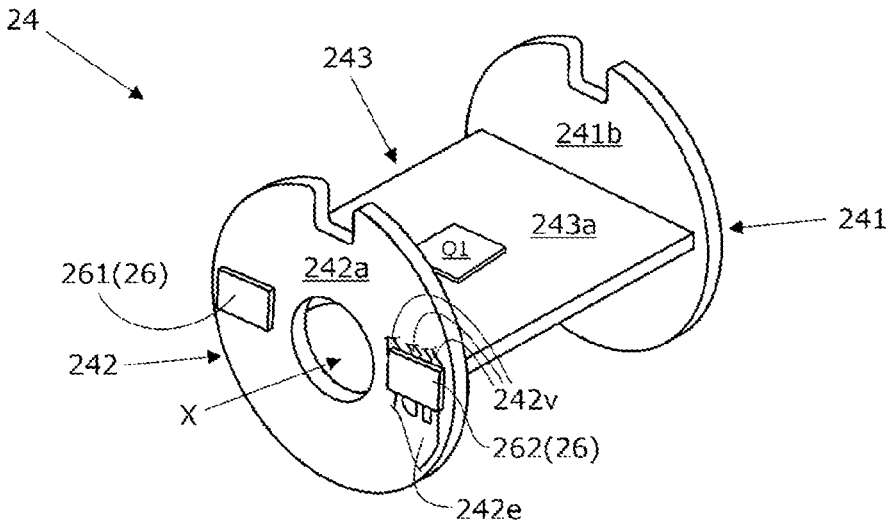
FIG. 7 is a perspective view of the substrate unit of FIG. 4 viewed from yet another direction.

The connection member 23 connects the capsule case 11 and the first case 21 and electrically connects the fixed electrode holder 124 and a signal pattern (first signal pattern 241*s*, see FIG. 5) of the below-described substrate unit 24. The connection member 23 includes a lock ring 231, a pin 232, and a pin support 233.

The lock ring 231 is made of metal and has a cylindrical shape. The lock ring 231 includes a male screw part 231*a* disposed on the outer circumferential surface. The pin 232 is made of metal and has a shell shape with a thin upper end. The pin support 233 is made of synthetic resin and has a mountain shape. The pin 232 is attached to an upper part of the pin support 233. The pin support 233 is fitted into the lock ring 231 to protrude upward.

The substrate unit 24 is a set of substrates on which elements, such as a field effect transistor (FET) 61 (see FIG. 8) and a buffer circuit, and the light source 26 are mounted. The lead wire 50 is connected to the substrate unit 24. The substrate unit 24 is accommodated in the first case 21. The substrate unit 24 includes a first substrate 241, a second substrate 242, and a third substrate 243. The FET 61 and the buffer circuit will be described below.

FIGS. 4 to 7 are perspective views of the substrate unit 24 viewed from different directions (four directions). For convenience of description, FIGS. 4 to 7 illustrate the FET 61 mounted on the substrate unit 24 and a first transistor Q1 constituting a part of the buffer circuit.

The first substrate 241 is a conversion substrate in the present invention. The FET 61 is mounted on the first substrate 241. The first substrate 241 has a disk shape having substantially the same diameter as an inner diameter of the first case 21. The first substrate 241 includes a mounting surface 241*a*, a facing surface 241*b*, a notch 241*c*, a first ground pattern 241*e*, and a plurality of first signal patterns 241*s*.

The mounting surface 241*a* is a first mounting surface in the present invention on which the FET 61 is mounted. The facing surface 241*b* is a first facing surface in the present invention, which faces the second substrate 242. The mounting surface 241*a* is a surface different from the facing surface 241*b*.

The notch 241*c* is a notch for disposing the pin support 233 of the connection member 23 (see FIGS. 2 and 3) at a fixed position. The notch 241*c* is disposed at a peripheral edge part of the first substrate 241.

The first ground pattern 241*e* constitutes a part of a ground path in the substrate unit 24. The first ground pattern 241*e* is disposed on each of the mounting surface 241*a* and the facing surface 241*b* via a through hole (not illustrated). The FET 61 is grounded via the first ground pattern 241*e*.

The first signal patterns 241*s* constitute a part of a transmission path of a sound signal in the substrate unit 24. Each of the first signal patterns 241*s* is disposed on each of the mounting surface 241*a* and the facing surface 241*b* via a through hole (not illustrated).

The second substrate 242 is a light source substrate in the present invention. The light source 26 is mounted on the second substrate 242. The second substrate 242 has a disk shape having the same diameter as that of the first substrate 241. The second substrate 242 includes a mounting surface 242*a*, a facing surface 242*b*, a notch 242*c*, an insertion hole 242*h*, a second ground pattern 242*e*, and a plurality of first power patterns 242*v*.

The mounting surface 242*a* is a second mounting surface in the present invention on which the light source 26 is mounted. The facing surface 242*b* is a second facing surface in the present invention, which faces the first substrate 241. The mounting surface 242*a* is a surface different from the facing surface 242*b*.

The notch 242*c* is a notch for disposing the light guide member 27 (see FIGS. 2 and 3) at a fixed position. The notch 242*c* is disposed on a peripheral edge part of the second substrate 242.

The insertion hole 242*h* is a hole through which the lead wire 50 (see FIG. 2) is passed. The insertion hole 242*h* is disposed at the center of the second substrate 242.

The second ground pattern 242*e* constitutes a part of the ground path in the substrate unit 24. The second ground pattern 242*e* is disposed on each of the mounting surface 242*a* and the facing surface 242*b* via a through hole (not illustrated). The light source 26 is grounded via the second ground pattern 242*e*.

The first power patterns 242*v* constitute a part of a transmission path of power to the light source 26 in the substrate unit 24. Each of the first power patterns 242*v* is disposed on each of the mounting surface 242*a* and the facing surface 242*b* via a through hole (not illustrated).

The third substrate 243 is a connection substrate in the present invention. The lead wire 50 (see FIG. 2) is connected to the third substrate 243 and the below-mentioned buffer circuit is mounted on the third substrate 243. The third substrate 243 has a rectangular plate shape (rectangular shape). The third substrate 243 includes a mounting surface 243*a*, a connection surface 243*b*, a notch 243*c*, a third ground pattern 243*e*, a plurality of second signal patterns 243*s*, and a plurality of second power patterns 243*v*.

The mounting surface 243*a* is a third mounting surface in the present invention on which the buffer circuit (first transistor Q1) is mounted. The connection surface 243*b* is a connection surface in the present invention, to which the lead wire 50 is connected. The mounting surface 243*a* is a surface different from the connection surface 243*b*.

The notch 243*c* is a notch through which the lead wire 50 is passed. The notch 243*c* is disposed at the center of a lower side (short side) of the third substrate 243.

The third ground pattern 243*e* constitutes a part of the ground path in the substrate unit 24. The third ground pattern 243*e* is disposed on each of the mounting surface 243*a* and the connection surface 243*b* via a through hole (not illustrated). The buffer circuit is grounded via the third ground pattern 243*e*.

The second signal patterns 243*s* constitute a part of the transmission path of the sound signal in the substrate unit 24. Each of the second signal patterns 243*s* is disposed on each of the mounting surface 243*a* and the connection surface 243*b* via a through hole (not illustrated). The below-mentioned signal line 51 (see FIG. 8) is connected to the second signal pattern 243*s* on the connection surface 243*b* by, for example, a solder.

The second power patterns 243*v* constitute a part of the transmission path of the power to the light source 26 in the substrate unit 24. Each of the second power patterns 243*v* is disposed on each of the mounting surface 243*a* and the connection surface 243*b* via a through hole (not illustrated). Each of the below-mentioned power lines 52 to 54 (see FIG. 8) is connected to each of the second power patterns 243*v* on the connection surface 243*b* by, for example, a solder.

The first substrate 241 is disposed above the second substrate 242 to face the second substrate 242 substantially in parallel. The facing surface 241*b* of the first substrate 241 faces the facing surface 242*b* of the second substrate 242. The third substrate 243 is disposed between the first substrate 241 and the second substrate 242. An upper side (one short side) of the third substrate 243 abuts on substantially the diameter line of the facing surface 241*b*. A lower side (the other short side) of the third substrate 243 abuts on substantially the diameter line of the facing surface 242*b*. The connection surface 243*b* of the third substrate 243 is disposed to stand upright from each of the two facing surfaces 241*b* and 242*b*. That is, an angle formed by the connection surface 243*b* and each of the two facing surfaces 241*b* and 242*b* is about 90°.

The insertion hole 242*h* of the second substrate 242 communicates with the notch 243*c* of the third substrate 243. The notch 243*c* functions to widen a disk-shaped space in the insertion hole 242*h* upward. As a result, the insertion hole 242*h* and the notch 243*c* form a substantially dome-shaped space X through which the lead wire 50 is passed. That is, the substrate unit 24 includes the space X through which the lead wire 50 is passed. Consequently, the space X (the insertion hole 242*h* and the notch 243*c*) enables many lines (thick line) to pass through the insertion hole 242*h*, as compared with a case where the lead wire 50 passes through only the insertion hole 242*h*. Furthermore, the lead wire 50 is passed from below through the space X in a substantially straight state, alternatively, a gently bent state. Therefore, a mechanical load applied to the lead wire 50 passing through the space X is small.

In the vicinity of the boundary between the first substrate 241 and the third substrate 243, the first ground pattern 241*e* disposed on the facing surface 241*b* is electrically connected to the third ground pattern 243*e* disposed on the adjacent connection surface 243*b* by a solder (hereinafter, referred to as a "first solder") S1. Each of the first signal patterns 241*s* disposed on the facing surface 241*b* is electrically connected to each of the second signal patterns 243*s* disposed on the adjacent connection surface 243*b* by each solder (hereinafter, referred to as "third solder") S3. That is, the first substrate 241 is also mechanically connected to the third substrate 243 to have a three-dimensional shape by the first solder S1 that electrically connects the first ground pattern 241*e* and the third ground pattern 243*e* and two third solders S3 that electrically connect the first signal patterns 241*s* and the second signal patterns 243*s*.

In the vicinity of the boundary between the second substrate 242 and the third substrate 243, the second ground pattern 242*e* disposed on the facing surface 242*b* is electrically connected to the third ground pattern 243*e* disposed on the adjacent mounting surface 243*a* by a solder (hereinafter, referred to as a "second solder") S2. Each of the first power patterns 242*v* disposed on the facing surface 242*b* is electrically connected to each of the second power patterns 243*v* disposed on each of the adjacent mounting surface 243*a* and connection surface 243*b* by each solder (hereinafter, referred to as "fourth solder") S4. That is, the second substrate 242 is also mechanically connected to the third substrate 243 to have a three-dimensional shape by the second solder S2 that electrically connects the second ground pattern 242*e* and the third ground pattern 243*e* and three fourth solders S4 that electrically connect the first power patterns 242*v* and the second power patterns 243*v*.

The first solder S1 connects the third ground pattern 243*e* and the second ground pattern 242*e* at one place. The second solder S2 connects the second ground pattern 242*e* and the third ground pattern 243*e* at one place. The two third solders S3 connect the first signal patterns 241*s* and the second signal patterns 243*s* at two places corresponding to a hot side and a cold side of the sound signal from the FET 61. The three fourth solders S4 connect the first power patterns 242*v* and the second power patterns 243*v* at three places corresponding to the colors of the light source 26 (three colors, RGB, in the present embodiment).

As described above, the first substrate 241, the second substrate 242, and the third substrate 243 are three-dimensionally connected to one another only by the first solder S1 to the fourth solders S4 that connect the paths (the ground path, the transmission path of the sound signal, and the transmission path of the power) in the substrate unit 24. That is, the first substrate 241, the second substrate 242, and the third substrate 243 are three-dimensionally connected to one another to constitute one three-dimensional substrate unit 24. As a result, the first substrate 241 and the third substrate 243 are electrically connected to each other at the shortest distance without the intervention of a lead wire and the like, and the second substrate 242 and the third substrate 243 are electrically connected to each other at the shortest distance without the intervention of a lead wire and the like. That is, the connection between the first substrate 241 and the third substrate 243, and the connection between the second substrate 242 and the third substrate 243 are stable (mechanical connection strength is increased) as compared with a case where circuit boards are connected to one another by a lead wire and the like. In other words, connection failure between the first substrate 241 and the third substrate 243 is suppressed and connection failure between the second substrate 242 and the third substrate 243 is also suppressed.

In the substrate unit 24, one ground path is formed by the first ground pattern 241*e*, the second ground pattern 242*e*, and the third ground pattern 243*e*. The ground path is used in common for a signal-based circuit corresponding to the output of sound signal, and for a power-based circuit corresponding to the supply of power to the light source 26.

The substrate unit 24 is assembled in a substantially three-dimensional "H" shape when viewed in a predetermined direction (a direction parallel to each of the mounting surfaces 241*a* to 243*a*). Therefore, although the substrate unit 24 is provided with the three substrates (the first substrate 241, the second substrate 242, and the third substrate 243), the length of the substrate unit 24 in the vertical direction (longitudinal direction of the microphone M) can be suppressed to substantially the length of the third substrate 243. The width (length of the microphone M in the radial direction) of the substrate unit 24 can be suppressed to the diameter of the first substrate 241 (the second substrate 242). That is, the substrate unit 24 can be accommodated in a columnar space having a size corresponding to the diameter of the first substrate 241 and the length of the third substrate 243. Consequently, the substrate unit 24 can be accommodated in the first case 21 in a compact manner while individually including a surface on which the FET 61 is mounted (the mounting surface 241*a*), a surface on which the light source 26 is mounted (the mounting surface 242*a*), a surface on which the buffer circuit (the first transistor Q1) is mounted (the mounting surface 243*a*), and a surface to which the lead wire 50 is connected (the connection surface 243*b*).

Referring back to FIGS. 2 and 3, the spacer 25 reinforces the substrate unit 24. The spacer 25 is made of synthetic resin and has a substantially semicylindrical shape. The spacer 25 is disposed between the first substrate 241 and the second substrate 242 to face the mounting surface 243*a* of the third substrate 243.

The light source 26 emits light and notifies the operation state of the capsule 1. The light source 26 is, for example, a multicolor LED chip provided with RGB three-color light emitting diodes (LEDs). The light source 26 includes a first light source 261 and a second light source 262. The first light source 261 and the second light source 262 are mounted on the mounting surface 242*a* (see FIG. 5) of the second substrate 242.

The "operation state of the capsule 1" includes, for example, a state in which the power of the microphone M is ON (state in which the microphone unit 12 is able to collect sound waves) and a state in which the power of the microphone M is OFF (state in which the microphone unit 12 is unable to collect sound waves).

The light guide member 27 guides the light from the light source 26 to the outside of the microphone M. The light guide member 27 is made of synthetic resin having translucency such as poly methyl methacrylate (PMMA) resin, for example. The light guide member 27 includes a ring-shaped body part 271, two protrusions 272 and 273, and a positioning part 274. An upper end of the body part 271 protrudes upward and constitutes the protrusions 272 and 273 having a substantially triangular shape and the positioning part 274 having a substantially columnar shape.

The light guide member 27 is fitted in the opening at the lower end of the first case 21. At this stage, the positioning part 274 is inserted into the notch 242*c* (see FIG. 5) of the second substrate 242, so that the light source 26 faces an upper surface of each of the protrusions 272 and 273.

Referring back to FIG. 1, the connection part 30 connects the input part 20 and the output part 40 and adjusts the direction of the input part 20 (the capsule 1) with respect to the output part 40. The connection part 30 includes a tubular first flexible pipe 31, a tubular joint 32, and a tubular second flexible pipe 33.

The first flexible pipe 31 and the second flexible pipe 33 are bent to adjust the direction of the input part 20 (the capsule 1: the microphone unit 12). The joint 32 connects the first flexible pipe 31 and the second flexible pipe 33.

The output part 40 processes the sound signal from the input part 20 and outputs the processed sound signal to a connection device (not illustrated) such as a microphone stand. The output part 40 includes a connector case 41, a circuit board (not illustrated) on which a part of the mounting element 60 (see FIG. 8) is mounted, and an output connector 42 (see FIG. 8). The mounting element 60 will be described below.

The connector case 41 accommodates the circuit board and a lower end of the connection part 30 (the second flexible pipe 33). The connector case 41 is made of metal and has a substantially columnar shape.

Figure 8:
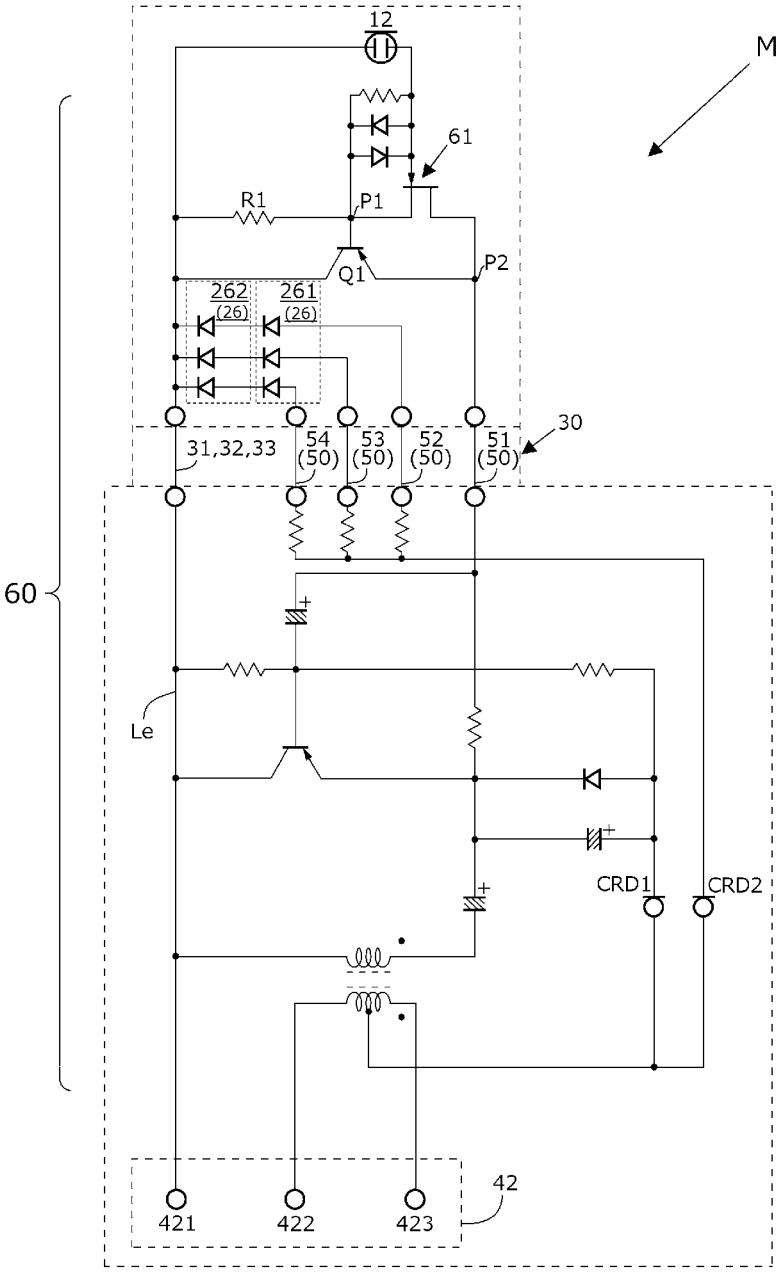
FIG. 8 is a circuit diagram of the microphone of FIG. 1.

FIG. 8 is a circuit diagram of the microphone M.

The output connector 42 outputs the sound signal from the FET 61 to the connection device. The output connector 42 includes a grounding terminal 421, a signal hot-side terminal 422, and a signal cold-side terminal 423.

The lead wire 50 transmits the sound signal from the microphone unit 12 and the power to each of the light source 26 and the FET 61. The lead wire 50 is wired in the connection part 30 and is connected to the third substrate 243 (see FIG. 2) of the input part 20 and the circuit board (not illustrated) of the output part 40. The lead wire 50 includes a signal line 51 that transmits the sound signal and the power to the FET 61, and power lines 52 to 54 that transmit the power to the light source 26.

The mounting element 60 transmits an electrical signal from the microphone unit 12 to the output connector 42, and transmits power from a phantom power source (not illustrated) to each of the FET 61 and the light source 26. The mounting element 60 includes the FET 61, the first transistor Q1, a first constant current diode CRD1, a second constant current diode CRD2, and a first resistor R1.

The FET 61 functions as an impedance converter that converts the output impedance of the microphone unit 12.

The first transistor Q1 generates operating power of the FET 61. The first resistor R1 sets the base potential of the first transistor Q1 and the source potential of the FET 61. The first resistor R1 is mounted on the third substrate 243.

The first transistor Q1 has a base connected to a source of the FET 61, an emitter connected to a drain of the FET 61, and a collector that is grounded. Therefore, when the first transistor Q1 operates, a base-emitter forward drop voltage of the first transistor Q1 is applied between the drain and source of the FET 61. This voltage becomes the operating power of the FET 61. In this way, the first transistor Q1 generates the operating power of the FET 61.

The first resistor R1 is connected between the base of the first transistor Q1 (a contact point P1 between the base of the first transistor Q1 and the source of the FET 61) and the reference potential, and sets the base potential of the first transistor Q1. The first transistor Q1 and the first resistor R1 constitute the buffer circuit connected to the output side of the FET 61.

Since the first transistor Q1 is a collector-grounded (emitter follower) transistor, an output signal of the FET 61 is output to a contact point P2 between the emitter of the first transistor Q1 and the drain of the FET 61. As a result, the output impedance of the first transistor Q1 decreases. Consequently, the microphone M can transmit the sound signal from the microphone unit 12 to the circuit board of the output part 40 through one signal line 51.

The first constant current diode CRD1 supplies predetermined power to the FET 61 and the first transistor Q1. The second constant current diode CRD2 supplies predetermined power to the first light source 261 and the second light source 262. The first constant current diode CRD1 and the second constant current diode CRD2 are mounted on the circuit board (not illustrated) of the output part 40.

Assembly of Microphone

The assembly of the microphone M will now be described with reference to FIGS. 1 to 8. The assembly of the microphone M is performed, for example, in the order of assembly of the capsule 1, assembly of the modular 2, and attachment of the capsule 1 to the modular 2.

First, the microphone unit 12 is accommodated in the capsule case 11. At this stage, the diaphragm 121 is electrically connected to the capsule case 11 via the diaphragm holder 122. The fixed electrode 123 and the fixed electrode holder 124 are insulated from the capsule case 11 by the insulator 125.

Then, the output connector 42, the circuit board (not illustrated), and the lower end of the connection part 30 (the second flexible pipe 33) are accommodated in the connector case 41. The lead wire 50 is wired in the connection part 30 with one end (lower end) connected to the circuit board.

Then, the upper end of the connection part 30 (the first flexible pipe 31) is accommodated in the second case 22. The other end (upper end) of the lead wire 50 extends upward from the upper end of the second case 22.

Then, the light guide member 27 is attached to the lower end of the first case 21. At this stage, the light guide member 27 is disposed at a fixed position with respect to the first case 21 by a positioning groove (not illustrated). The insertion part 21*b* of the first case 21 is disposed in the light guide member 27.

Then, the upper end of the lead wire 50 is passed through the insertion part 21*b* of the first case 21. The upper end of the lead wire 50 is passed from below through the insertion hole 242*h* of the second substrate 242 and the notch 243*c* of the third substrate 243. That is, the upper end of the lead wire 50 is passed through the space X formed by the insertion hole 242*h* and the notch 243*c*. The upper end of the lead wire 50 is connected to the connection surface 243*b* of the third substrate 243 of the substrate unit 24 by a solder. The signal line 51 is connected to the second signal pattern 243*s*, and the power lines 52 to 54 are connected to the second power patterns 243*v*.

The lead wire 50 is passed through the space X (the insertion hole 242*h* and the notch 243*c*), and thus is connected to the patterns of the connection surface 243*b* (the second signal pattern 243*s* and the second power patterns 243*v*) in a state along the longitudinal direction of the microphone M (a state substantially parallel to the connection surface 243*b*). That is, the lead wire 50 is soldered in a direction orthogonal to the attachment direction of the patterns of the connection surface 243*b*. Therefore, the occurrence of electrical connection failure such as pattern peeling and solder crack is suppressed. When the lead wire is soldered to the patterns in a state different from the present invention, that is, a state in which the lead wire is nearly perpendicular to the connection surface, the lead wire is soldered to the patterns with its distal end bent. Such connection applies a mechanical load to each of the solder and the lead wire, and thus facilitates the occurrence of electrical connection failure. As described above, in the configuration of the present embodiment, the mechanical load that the solders connecting the lead wire 50 and the patterns of the connection surface 243*b* receives from the lead wire 50 is reduced compared with the case where the lead wire is connected nearly perpendicular to the connection surface.

Then, the spacer 25 is disposed between the first substrate 241 and the second substrate 242 of the substrate unit 24. The substrate unit 24 is accommodated in the first case 21 with the mounting surface 242*a* of the second substrate 242 facing downward. At this stage, the positioning part 274 of the light guide member 27 is disposed in the notch 242*c* of the second substrate 242. As a result, the light source 26 is disposed at a fixed position with respect to the light guide member 27. That is, the first light source 261 faces the upper surface of the protrusion 272 of the light guide member 27, and the second light source 262 faces the protrusion 273 of the light guide member 27.

Then, the male screw part 22*a* of the second case 22 is screwed into the second female screw part 21*d* of the first case 21 inside the light guide member 27, so that the first case 21 is attached to the second case 22. At this stage, the body part 271 of the light guide member 27 is interposed between the first case 21 and the second case 22 with its outer circumferential surface exposed from the first case 21 and the second case 22.

Figure 9:
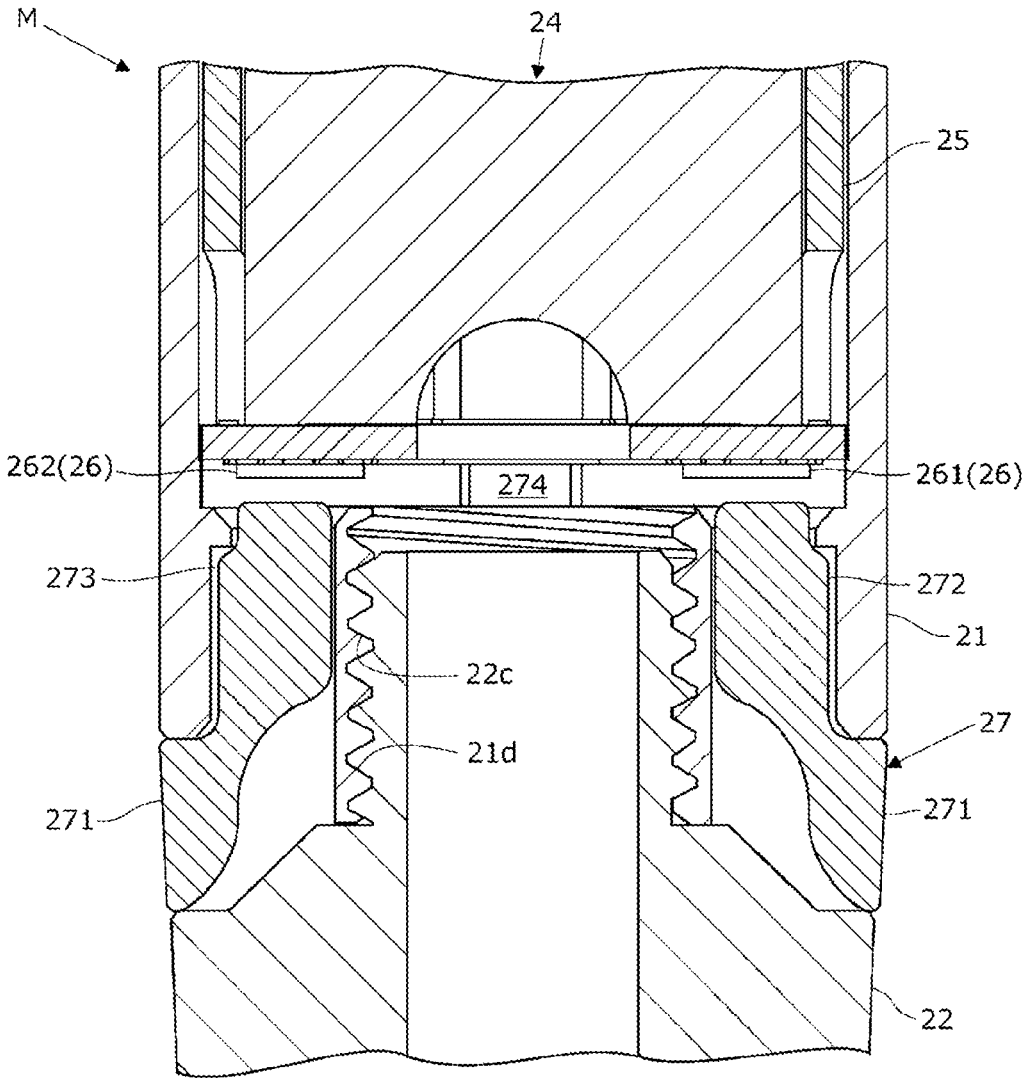
FIG. 9 is a partially enlarged cross-sectional view taken along line B-B of the microphone of FIG. 2.

FIG. 9 is a partially enlarged cross-sectional view taken along line B-B of the microphone M of FIG. 2.

FIG. 9 illustrates that the first light source 261 faces the upper surface of the protrusion 272 of the light guide member 27 and the second light source 262 faces the protrusion 273 of the light guide member 27. Furthermore, FIG. 9 illustrates that the body part 271 of the light guide member 27 is interposed between the first case 21 and the second case 22 with only the outer circumferential surface exposed.

In this way, the first case 21 and the second case 22 are connected to each other, so that the first case 21 and the second case 22 electrically shield the substrate unit 24 with a part of the light guide member 27 (outer circumferential surface of the body part 271) exposed. As a result, the microphone M reliably shields the substrate unit 24 and the lead wire 50 from, for example, electromagnetic waves from the outside of the microphone M, and radiates only light from the light source 26 to the outside of the microphone M via the light guide member 27.

Figure 10:
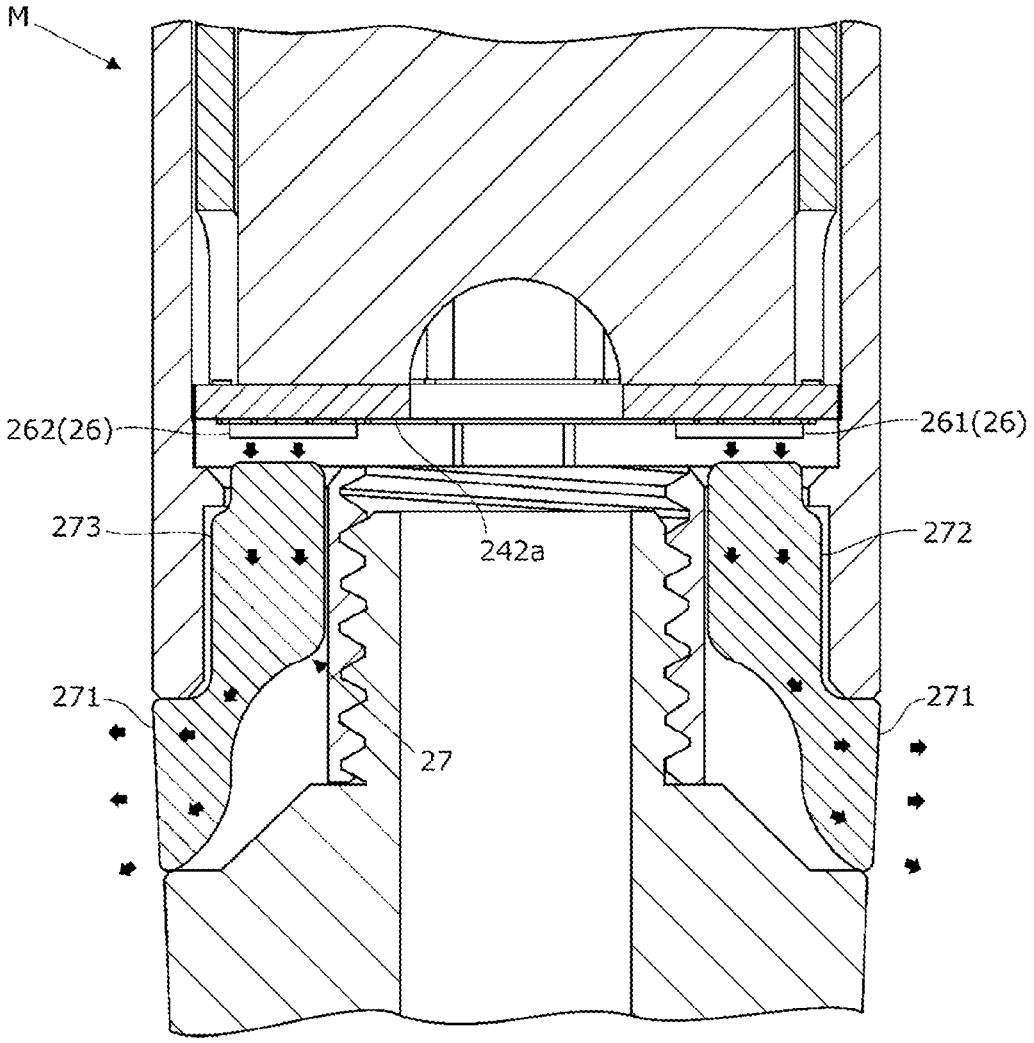
FIG. 10 is a schematic cross-sectional view illustrating a state in which light from a light source included in the microphone of FIG. 1 is guided.

FIG. 10 is a schematic cross-sectional view schematically illustrating a state in which light from the light source 26 is guided to the light guide member 27. FIG. 10 illustrates a state in which light from each of the first light source 261 and the second light source 262 is guided to the light guide member 27 with black arrows. As illustrated in FIG. 10, each of the first light source 261 and the second light source 262 outputs light in a direction (downward) to which the mounting surface 242*a* faces. The light from the first light source 261 and the second light source 262 is incident on the upper surfaces of the protrusions 272 and 273, then being guided to the protrusions 272 and 273 and the body part 271, and then being radiated from the outer circumferential surface of the body part 271 outward in the radial direction of the body part 271. In this way, the light guide member 27 guides the light from the light source 26 in a direction different from the direction to which the mounting surface 242*a* faces.

Referring back to FIGS. 1 to 8, the male screw part 231*a* of the lock ring 231 is then screwed into the first female screw part 21*c* of the first case 21, so that the connection member 23 is attached to the upper end of the first case 21. At this stage, a part of the pin support 233 is disposed in the notch 241*c* of the first substrate 241. As a result, a wiring (not illustrated) included in the pin support 233 is disposed at a fixed position with respect to the first signal patterns 241*s* of the first substrate 241, and is electrically connected to the first signal patterns 241*s*. Furthermore, the pin 232 and the first signal patterns 241*s* of the first substrate 241 are electrically connected to each other by this wiring.

The substrate unit 24 is pressed downward by the connection member 23 (the pin support 233). As a result, the second ground pattern 242*e* disposed on the mounting surface 242*a* of the second substrate 242 abuts the substrate holding part 21*a* of the first case 21. As a result, the substrate unit 24 is fixed in the first case 21 by a part (the substrate holding part 21*a*) of the first case 21 and the connection member 23. Furthermore, as described above, a part of the pin support 233 is disposed in the notch 241*c* and a part (the positioning part 274) of the light guide member 27 is disposed in the notch 242*c*. Consequently, in the circumferential direction of the first case 21, the substrate unit 24 is disposed at a fixed position. That is, the substrate unit 24 does not rotate in the circumferential direction of the first case 21.

Figure 11:
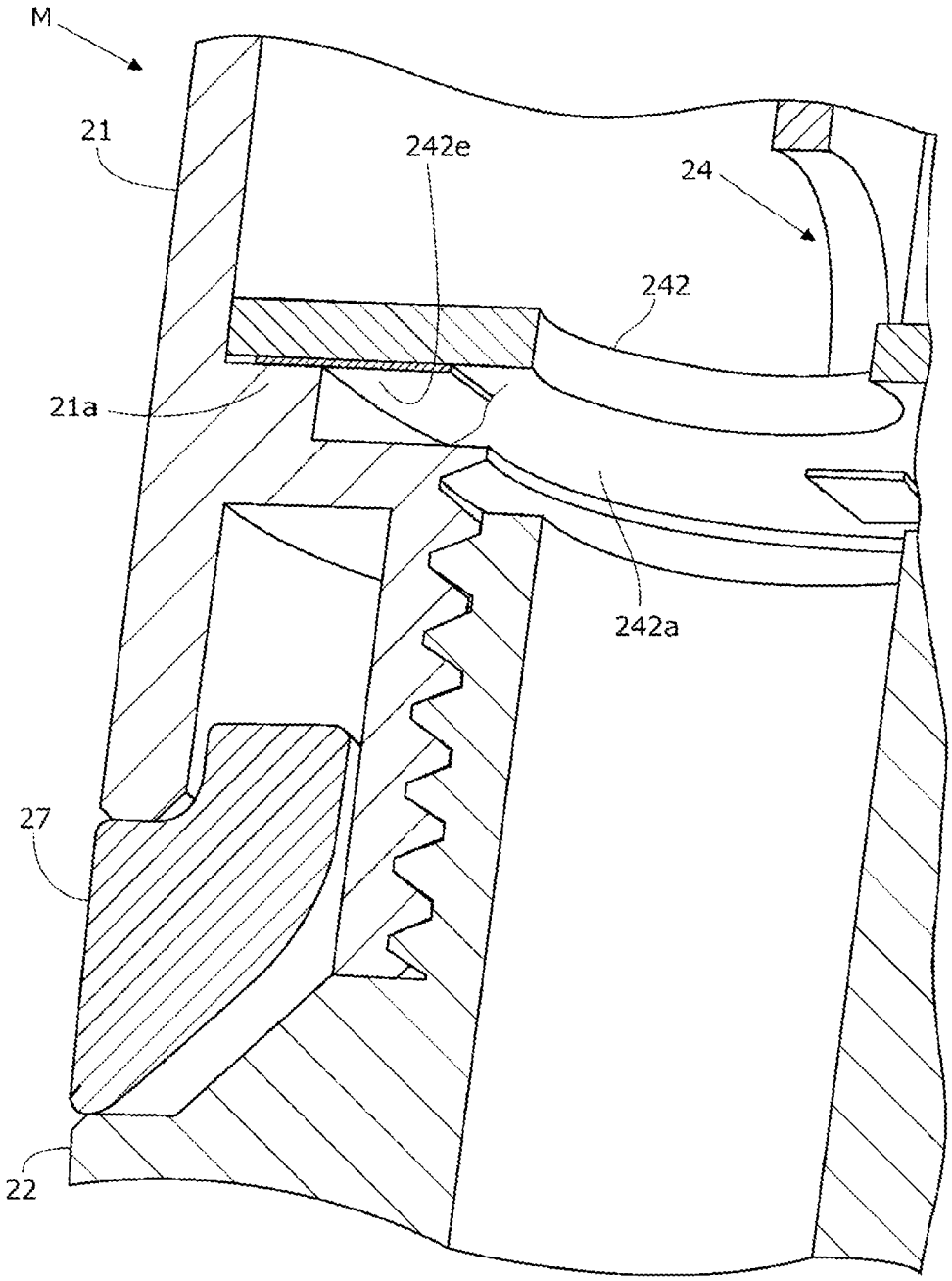
FIG. 11 is a partially enlarged cross-sectional perspective view illustrating a state in which a first case and the substrate unit included in the microphone of FIG. 1 abut each other.

FIG. 11 is a partially enlarged cross-sectional perspective view illustrating a state in which the first case 21 and the substrate unit 24 abut each other. FIG. 11 illustrates that the second ground pattern 242*e* disposed on the mounting surface 242*a* abuts the substrate holding part 21*a*.

In this way, the second ground pattern 242*e* abuts the first case 21, so that the second ground pattern 242*e* is electrically connected to the first case 21. That is, the ground path of the substrate unit 24 is electrically connected to the first case 21 via the second ground pattern 242*e*. Consequently, one place (the second ground pattern 242*e* in the present embodiment) of the path is electrically connected to the first case 21, so that the ground path of the substrate unit 24 is connected to a modular case ground path. The modular case ground path is a ground path provided with the housing of the modular 2, that is, the first case 21, the second case 22, the first flexible pipe 31, the joint 32, the second flexible pipe 33, and the connector case 41.

As described above, the substrate holding part 21*a* protrudes in the elliptical ring shape inside the first case 21. Therefore, the length of the substrate holding part 21*a* protruding on the mounting surface 242*a* of the second substrate 242 varies in the circumferential direction of the second substrate 242. As a result, the substrate holding part 21*a* can increase only an area of a part connected to the second ground pattern 242*e* while holding the entire circumference of the outer edge of the second substrate 242.

Referring back to FIGS. 1 to 8, as described above, the third substrate 243 is disposed between the first substrate 241 and the second substrate 242 to stand upright from each of the first substrate 241 and the second substrate 242. Furthermore, the spacer 25 is disposed between the first substrate 241 and the second substrate 242. The spacer 25 supports the first substrate 241 from below when the substrate unit 24 is pressed from above by the connection member 23. As a result, the mechanical load applied to the solders (the first solder S1 and the third solders S3) connecting the first substrate 241 and the third substrate 243 is reduced.

When the connection member 23 is attached to the first case 21, the upper half part of the male screw part 231*a* of the lock ring 231 is exposed to the extent that the capsule 1 can be attached.

Then, the male screw part 231*a* of the lock ring 231 is screwed into the female screw part 11*a* of the capsule case 11, so that the capsule 1 is attached to the modular 2. At this stage, the contact part 124*b* of the fixed electrode holder 124 and the pin 232 are electrically connected to each other. Therefore, the fixed electrode 123 is electrically connected to the first signal patterns 241*s* via the fixed electrode holder 124, the pin 232, and the wiring (not illustrated). The capsule case 11 is electrically connected to the first case 21 via the lock ring 231. As a result, the capsule case 11 electrically shields the microphone unit 12. The diaphragm 121 is grounded via the ground path (path indicated by reference numeral Le in FIG. 8) provided with the diaphragm holder 122, the capsule case 11, and the modular case ground path.

In the microphone M assembled as described above, the substrate unit 24 is three-dimensionally configured. Furthermore, the ground path of the signal-based circuit and the ground path of the power-based circuit in the substrate unit 24 are common. Moreover, a sound signal is transmitted by the buffer circuit via one signal line 51. Therefore, in the microphone M in the present embodiment, the outer shape (that is, the outer diameter of the input part 20) of the first case 21 can be miniaturized. As a result, in the microphone M, the ratio (OD1/OD2) of the outer diameter OD1 of the first case 21 to the outer diameter OD2 of the first flexible pipe 31 is, for example, within the range of 1.4 to 1.6 (about 1.52 in the present embodiment). Therefore, the microphone M has one bar-shaped outer shape with slight irregularities (variation in diameter) from the input part 20 to the connection part 30. That is, the microphone M has an excellent design property in its appearance.

Furthermore, in the microphone M, the substrate unit 24 is disposed in the order of the first substrate 241, the third substrate 243, and the second substrate 242 from the microphone unit 12 side. Therefore, the transmission path of a sound signal from the microphone unit 12 to the FET 61 can be shortened. Furthermore, such an arrangement enables light from the light source 26 to be guided to the outside of the microphone M with the usage of the light guide member 27 disposed below the substrate unit 24.

Moreover, the lead wire 50 is connected to the third substrate 243 disposed between the first substrate 241 and the second substrate 242. Power from the phantom power source is distributed to the FET 61 of the first substrate 241 and the light source 26 of the second substrate 242 by the third substrate 243. In other words, the transmission path of the power from the phantom power source is substantially equally divided into two paths (the path to the light source 26 and the path to the FET 61) in the substrate unit 24. Consequently, the transmission path of the power to each of the light source 26 and the FET 61 has a simple circuit configuration with no extra transmission path and is shortened as compared with a case where power transmission paths are connected in series. Furthermore, the transmission path of the power to each of the light source 26 and the FET 61 is shortened as compared with a case where a plurality of circuit boards are connected to one another by, for example, a lead wire. As a result, parasitic impedance of the power transmission path is reduced, so that the occurrence of unexpected problems is suppressed.

Moreover, the first case 21 and the second case 22 are electrically connected to each other inside the light guide member 27. As a result, the substrate unit 24 and the lead wire 50 are electrically shielded by the first case 21 and the second case 22. Light from the light source 26 is radiated to the outside of the microphone M via the light guide member 27 interposed between the first case 21 and the second case 22.

It should be noted that the microphone according to the present invention can easily change directionality while maintaining the outer diameter of the sound collection part by exchanging the capsules with different directivities.

Figure 12:
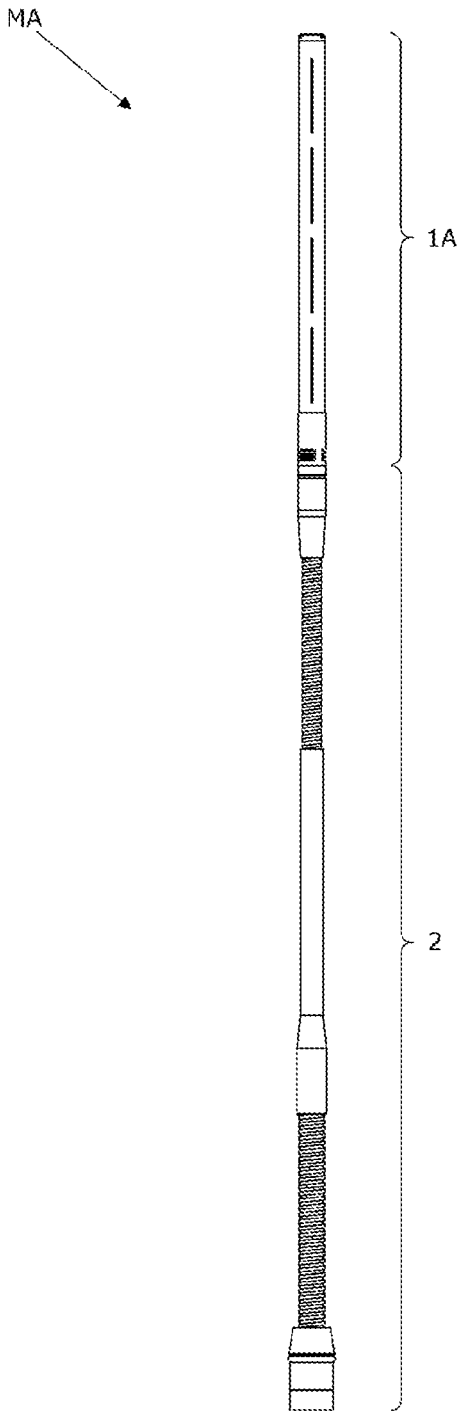
FIG. 12 is a side view illustrating a microphone in a state in which a super-directional microphone capsule is attached to a modular gooseneck section included in the microphone of FIG. 1.

FIG. 12 is a side view illustrating a microphone MA in a state in which a super-directional capsule is attached to the modular 2.

FIG. 12 illustrates that a super-directional capsule 1A, instead of the unidirectional capsule 1 (see FIG. 1), is attached to the modular 2. FIG. 12 illustrates that the microphone MA to which the super-directional capsule 1A is attached has one bar-shaped outer shape from an input part 20A to the connection part 30, similarly to the microphone M illustrated in FIG. 1.

CONCLUSION

According to the embodiment described above, the first substrate 241 on which the FET 61 is mounted, the second substrate 242 on which the light source 26 is mounted, and the third substrate 243 to which the lead wire 50 is connected are three-dimensionally connected to one another to constitute one substrate unit 24. Therefore, the substrate unit 24 is miniaturized while individually including the surface (the mounting surface 241*a*) on which the FET 61 is mounted, the surface (the mounting surface 242*a*) on which the light source 26 is mounted, and the surface (the connection surface 243*b*) to which the lead wire 50 is connected.

Furthermore, according to the embodiment described above, the first substrate 241 is disposed to face the second substrate 242, and the third substrate 243 is disposed between the first substrate 241 and the second substrate 242. Therefore, although the substrate unit 24 is provided with the three substrates (the first substrate 241, the second substrate 242, and the third substrate 243), the configuration of the substrate unit 24 enables the length of the substrate unit 24 in a predetermined direction (the vertical direction in the present embodiment) to be suppressed to a region where the lead wire 50 is connected, that is, to about the size (length) of the third substrate 243.

Moreover, power from the phantom power source is distributed to the FET 61 of the first substrate 241 and the light source 26 of the second substrate 242 by the third substrate 243. Therefore, as compared with a case where a plurality of circuit boards are connected to one another by, for example, a lead wire, the transmission path of the power to each of the light source 26 and the FET 61 is shortened. As a result, the parasitic impedance of the transmission path is reduced, so that the occurrence of unexpected problems is suppressed. Consequently, in the substrate unit 24, an influence (such as fluctuation of the reference potential) to a sound signal in the transmission path of the sound signal sharing the ground path with the transmission path of the power is also suppressed.

Moreover, in the microphone according to the embodiment described above, the connection surface 243*b* of the third substrate 243 is disposed to stand upright from each of the facing surface 241*b* of the first substrate 241 and the facing surface 242*b* of the second substrate 242. That is, the substrate unit 24 is configured to be in a substantially H shape when viewed in a predetermined direction. Therefore, the substrate unit 24 can be accommodated in a columnar space corresponding to the diameter of the first substrate 241 (the second substrate 242) and the length of the third substrate 243 in the vertical direction. Consequently, the first case 21 is miniaturized as compared with a case where a plurality of circuit boards are accommodated side by side.

In this way, the substrate unit 24 is miniaturized, so that the microphone M can be miniaturized while having the light source 26 (light emitting part).

Moreover, according to the embodiment described above, the second substrate 242 includes the insertion hole 242*h*, and the third substrate 243 includes the notch 243*c*. The insertion hole 242*h* and the notch 243*c* communicate with each other to form the space X through which the lead wire 50 is passed. In other words, the space X is formed by the second substrate 242 and the third substrate 243. The lead wire 50 (the signal line 51 and the power lines 52 to 54) is passed through the space X from below and is connected to the connection surface 243*b* of the third substrate 243 by a solder. Therefore, the lead wire 50 can be connected to the connection surface 243*b* along the longitudinal direction of the microphone M (a state substantially parallel to the connection surface 243*b*). As a result, the mechanical load that the solder connecting the lead wire 50 and the connection surface 243*b* receives from the lead wire 50 is reduced as compared with a case where the lead wire is connected nearly perpendicular to the connection surface.

Moreover, according to the embodiment described above, the spacer 25 is disposed between the first substrate 241 and the second substrate 242. Therefore, the mechanical load applied to the solders (the first solder S1 and the third solders S3) connecting the first substrate 241 and the third substrate 243 is reduced.

Moreover, according to the embodiment described above, the mounting surface 241*a* on which the FET 61 is mounted is a surface different from the facing surface 241*b*, and the mounting surface 242*a* on which the light source 26 is mounted is a surface different from the facing surface 242*b*. The substrate unit 24 is disposed in the order of the first substrate 241, the third substrate 243, and the second substrate 242 from the microphone unit 12 side. That is, the FET 61 is directed to the upper microphone unit 12 side, and the light source 26 is directed to the lower light guide member 27. Therefore, the path of the sound signal from the microphone unit 12 to the FET 61 can be shortened. The shortening of the path reduces an adverse influence due to the parasitic impedance of a path on a sound signal from the microphone unit 12, which is a weak signal.

Moreover, according to the embodiment described above, the light guide member 27 is disposed close to the second substrate 242 and guides light from the light source 26 in a direction (outward in the radial direction of the body part 271 in the present embodiment) different from a direction (downward direction in the present embodiment) to which the mounting surface 242*a* faces. Therefore, the microphone M can radiate the light from the light source 26 to the outside of the microphone M while ensuring an electrical shield due to the metal housing.

Moreover, according to the embodiment described above, the first transistor Q1 that generates the operating power of the impedance converter and constitutes the buffer circuit is mounted on the mounting surface 243*a* of the third substrate 243. The mounting surface 243*a* is different from the connection surface 243*b*. Therefore, the substrate unit 24 is miniaturized while individually including the surface (the mounting surface 241*a*) on which the FET 61 is mounted, the surface (the mounting surface 242*a*) on which the light source 26 is mounted, the surface (the connection surface 243*b*) to which the lead wire 50 is connected, and the surface (the mounting surface 243*a*) on which the buffer circuit is mounted.

Moreover, according to the embodiment described above, the first substrate 241 is also mechanically connected to the third substrate 243 by the first solder S1 that electrically connects the first ground pattern 241*e* and the third ground pattern 243*e*. Similarly, the second substrate 242 is electrically and mechanically connected to the third substrate 243 by the second solder S2. Therefore, the first substrate 241, the second substrate 242, and the third substrate 243 are three-dimensionally connected to one another by the first solder S1 and the second solder S2. Furthermore, in the substrate unit 24, one ground path common to each of the first substrate 241, the second substrate 242, and the third substrate 243 is formed. As a result, in the substrate unit 24, an area required for the arrangement of the ground path is reduced. That is, the substrate unit 24 is miniaturized.

Moreover, according to the embodiment described above, the first substrate 241 is also mechanically connected to the third substrate 243 by the two third solders S3 that electrically connect the first signal patterns 241*s* and the second signal patterns 243*s*. The second substrate 242 is also mechanically connected to the third substrate 243 by the three fourth solders S4 that electrically connect the first power patterns 242*v* and the second power patterns 243*v*. Therefore, the first substrate 241, the second substrate 242, and the third substrate 243 are three-dimensionally connected to one another only by the first solder S1 to the fourth solders S4 that connect the ground path, the transmission path of the sound signal, and the transmission path of the power. That is, the first substrate 241 and the third substrate 243 are electrically connected to each other at the shortest distance without the intervention of a lead wire and the like, and the second substrate 242 and the third substrate 243 are electrically connected to each other at the shortest distance without the intervention of a lead wire and the like. As a result, the three-dimensional and compact substrate unit 24 is configured. Furthermore, the mechanical and electrical connection between the first substrate 241 and the third substrate 243 and the mechanical and electrical connection between the second substrate 242 and the third substrate 243 are stable as compared with a case where circuit boards are connected to one another by a lead wire and the like.

Moreover, according to the embodiment described above, the substrate unit 24 is electrically connected to the first case 21 via the second ground pattern 242*e*. The first case 21 is grounded via the connection part 30 (the first flexible pipe 31, the joint 32, and the second flexible pipe 33) and the output part 40 (the connector case 41). Therefore, the ground path of the substrate unit 24 is connected to the modular case ground path via one-point connection between the second ground pattern 242*e* and the first case 21.

Moreover, according to the embodiment described above, the substrate unit 24 is fixed in the first case 21 by a part of the first case 21 (the substrate holding part 21*a*) and the connection member 23. Therefore, when an impact of, for example, dropping is applied to the microphone M, the substrate unit 24 does not move within the first case 21 (does not collide with the first case 21). As a result, failure in the substrate unit 24 is avoided.

It should be noted that the electrical connection between the ground path of the substrate unit and the first case is not limited to the connection between the second ground pattern and the first case. That is, for example, the ground path of the substrate unit and the first case may be electrically connected to each other by the lock ring abutting the first ground pattern of the first substrate.

Furthermore, the light source may be provided with a single color LED chip. In such a case, since the number of power lines is reduced as compared with a case where the light source is provided with multicolor LED chips, the third substrate can be miniaturized. The diameter of each of the first substrate and the second substrate depends on the size (width) of the third substrate. Therefore, when the third substrate is miniaturized, each of the first substrate and the second substrate (that is, the entire substrate unit) is miniaturized.

Moreover, the number of solders that connect the first substrate, the second substrate, and the third substrate is not limited to the present embodiment, as long as the number corresponds to the number of patterns to be connected. That is, for example, when the light source is provided with a single color LED chip, the fourth solder may connect power patterns at one place.

Moreover, the lead wire may not be passed through the notch of the third substrate as long as the lead wire is passed through the insertion hole of the second substrate.

Moreover, the protruding shape of the substrate holding part is not limited to the elliptical ring shape. That is, for example, the substrate holding part may protrude in a ring shape or a polygonal shape.

The invention claimed is:

1. A microphone comprising:

a microphone unit;

an impedance converter that converts output impedance of the microphone unit;

a light source that notifies an operation state of the microphone unit;

a conversion substrate on which the impedance converter is mounted;

a light source substrate on which the light source is mounted; and a connection substrate to which a signal line that transmits a signal from the impedance converter and a power line that transmits power to the light source are connected, wherein the conversion substrate, the light source substrate, and the connection substrate are three-dimensionally connected to one another to constitute one substrate unit.

2. The microphone according to claim 1, wherein the substrate unit includes a space through which each of the signal line and the power line is passed, and the space is formed by the light source substrate and the connection substrate.

3. The microphone according to claim 2, wherein the light source substrate includes an insertion hole through which each of the signal line and the power line is passed, the connection substrate includes a notch through which each of the signal line and the power line is passed, and the space is formed by the notch and the insertion hole that communicate with each other.

4. The microphone according to claim 3, wherein the light source substrate has a disk shape, the insertion hole is disposed at a center of the light source substrate, the connection substrate has a rectangular shape, and the notch is disposed at a center of a short side abutting the light source substrate, among short sides of the connection substrate.

5. The microphone according to claim 3, wherein each of the signal line and the power line is passed through the space and connected to the connection substrate in a state substantially parallel to the connection substrate.

6. The microphone according to claim 1, wherein
the conversion substrate is disposed to face the light source substrate, and
the connection substrate is disposed between the conversion substrate and the light source substrate.

7. The microphone according to claim 6, wherein
the conversion substrate includes a first facing surface that faces the light source substrate,
the light source substrate includes a second facing surface that faces the conversion substrate,
the connection substrate includes a connection surface to which the signal line and the power line are connected, and
the connection surface is disposed to stand upright from each of the first facing surface and the second facing surface.

8. The microphone according to claim 7, wherein
the conversion substrate has a plate shape and includes a first mounting surface on which the impedance converter is mounted,
the light source substrate has a plate shape and includes a second mounting surface on which the light source is mounted, and
the first mounting surface is a surface different from the first facing surface and the second mounting surface is a surface different from the second facing surface.

9. The microphone according to claim 8, wherein the substrate unit is disposed in an order of the conversion substrate, the connection substrate, and the light source substrate from a side of the microphone unit.

10. The microphone according to claim 8, further comprising:
a light guide member that guides light from the light source in a direction different from a direction to which the second mounting surface faces.

11. The microphone according to claim 6, further comprising:
a spacer disposed between the conversion substrate and the light source substrate.

12. The microphone according to claim 1, further comprising:
a transistor that generates operating power of the impedance converter, wherein
the transistor is mounted on the connection substrate.

13. The microphone according to claim 12, wherein
the connection substrate includes:
a connection surface to which the signal line and the power line are connected; and
a third mounting surface on which the transistor is mounted, and
the third mounting surface is a surface different from the connection surface.

14. The microphone according to claim 1, wherein
the conversion substrate includes a first ground pattern,
the light source substrate includes a second ground pattern,
the connection substrate includes a third ground pattern,
the conversion substrate is connected to the connection substrate by a first solder that electrically connects the first ground pattern and the third ground pattern, and
the light source substrate is connected to the connection substrate by a second solder that electrically connects the second ground pattern and the third ground pattern.

15. The microphone according to claim 14, wherein
the conversion substrate includes a first signal pattern to which a signal output from the impedance converter is transmitted,
the light source substrate includes a first power pattern to which power to the light source is transmitted,
the connection substrate includes:
a second signal pattern to which the signal output from the impedance converter is transmitted; and
a second power pattern to which the power to the light source is transmitted,
the conversion substrate is connected to the connection substrate by a third solder that electrically connects the first signal pattern and the second signal pattern, and
the light source substrate is connected to the connection substrate by a fourth solder that electrically connects the first power pattern and the second power pattern.

16. The microphone according to claim 14, further comprising:
a case that accommodates the substrate unit, wherein
the substrate unit is electrically connected to the case via at least one of the first ground pattern and the second ground pattern.

17. The microphone according to claim 1, further comprising:
a unit case that accommodates the microphone unit;
a case that accommodates the substrate unit; and
a connection member that connects the unit case and the case, wherein
the substrate unit is fixed in the case by a part of the case and the connection member.

18. The microphone according to claim 1, further comprising:
a case that accommodates the substrate unit; and
a flexible pipe that adjusts a direction of the microphone unit, wherein
each of the signal line and the power line is wired in the flexible pipe, and
a ratio of an outer diameter of the case to an outer diameter of the flexible pipe is within a range of 1.4 to 1.6.

* * * * *